US005971316A

United States Patent [19]

Kim

[11] Patent Number: 5,971,316

[45] Date of Patent: Oct. 26, 1999

[54] OPTICAL FIBER SPOOL AND SPOOL COVER

[75] Inventor: Kyeong-Sup Kim, Taegu-kwangyokshi, Rep. of Korea

[73] Assignee: Samsung Electronics Co., Ltd., Kyungki-do, Rep. of Korea

[21] Appl. No.: 09/093,618

[22] Filed: Jun. 9, 1998

[30] Foreign Application Priority Data

Jun. 11, 1997 [KR] Rep. of Korea ..... 1997-13865

[51] Int. Cl.[6] ..... B65H 75/14; B65D 85/672

[52] U.S. Cl. ..... 242/601; 242/603; 242/609; 242/610.4; 206/398

[58] Field of Search ..... 242/601, 603, 242/609.1, 609, 609.4, 610.4, 614.1, 118.4, 118.7, 118.8, 125.1; 206/398, 401, 400, 402, 403

[56] References Cited

U.S. PATENT DOCUMENTS

| | | | |
|---|---|---|---|
| 1,488,322 | 3/1924 | Doty . | |
| 1,702,242 | 2/1929 | Bureau . | |
| 1,742,584 | 1/1930 | Daubmeyer et al. | 242/601 |
| 1,981,139 | 11/1934 | Bureau . | |
| 2,741,441 | 4/1956 | LeBus . | |
| 3,286,829 | 11/1966 | Lyman et al. | 206/398 |
| 3,391,879 | 7/1968 | LeBus . | |
| 3,650,388 | 3/1972 | Osojnak . | |
| 4,387,863 | 6/1983 | Edmonston et al. | 242/118.4 |
| 4,635,789 | 1/1987 | Webb . | |
| 4,696,438 | 9/1987 | Myers . | |
| 4,974,789 | 12/1990 | Milburn . | |
| 5,067,665 | 11/1991 | LoStracco et al. | 242/118.4 |
| 5,246,184 | 9/1993 | Trewhella | 242/610.4 |
| 5,335,874 | 8/1994 | Shrum et al. | 242/118.4 |
| 5,702,066 | 12/1997 | Hurst et al. . | |

*Primary Examiner*—John M. Jillions
*Attorney, Agent, or Firm*—Robert E. Bushnell, Esq.

[57] ABSTRACT

In an optical fiber spool, an optical fiber is wound around a barrel, a resilient pad covers the outer surface of the barrel, for relieving impacts, and two flanges face each other to support the barrel. A reinforcing rib is fixed on each of the flanges, for supporting the wound optical fiber, and an auxiliary winding portion is disposed on the outer surface of one flange, for winding a beginning portion of the optical fiber. An optical fiber drawing slot is positioned on the one flange, spaced apart from an inner circumference toward the flange in the direction of an outer circumference thereof by a predetermined distance, and has an upper surface spaced apart from the inner circumference of flange by a distance 2t, the thickness of the pad being t.

5 Claims, 3 Drawing Sheets

OPTICAL FIBER SPOOL AND SPOOL COVER

CLAIM OF PRIORITY

This application makes reference to, incorporates the same herein, and claims all benefits accruing under 35 U.S.C. §119 from an application for OPTICAL FIBER SPOOL AND SPOOL COVER earlier filed in the Korean Industrial Property Office on Jun. 11, 1997 and there duly assigned Serial No. 13865/1997.

BACKGROUND OF THE INVENTION

1. Field of the Invention

The present invention relates to an optical fiber spool, and in particular, to an optical fiber spool and a spool cover for use in storing and transporting an optical fiber.

2. Description of the Related Art

An optical fiber is generally used as an intermediate product for a cable or a completed product in itself. Recently, there has been a drastically increasing demand for optical fibers to establish a superhigh-speed information communications network.

When optical fibers are to come onto the market in the form of cables, they are protected by a multi-protection layer so that their optical and mechanical characteristics can be well maintained. On the other hand, when optical fibers are shipped as a completed product, an additional mechanism should be prepared to maintain their characteristics. As user demand shifts to a long optical fiber, a spool capable of winding a long optical fiber is necessary.

An earlier optical fiber spool has been designed to wind an optical fiber of a short length of about 15–20 km. This spool has a cylindrical barrel and two flanges facing each other with the barrel in between. The spool is easy to handle because the difference between diameters of the barrel and the flanges is narrow, about 83–88 mm, and an optical fiber wound around the spool is lightweight.

However, as user demand shifts to a long optical fiber, the earlier spool has limitations in winding the long optical fiber. Even if a long length of optical fiber is forcedly wound around the spool, end portions of the flanges are warped, thereby collapsing the optical fiber. Especially, the spool is seriously deformed depending on temperature due to the increase in the weight of the optical fiber and difficult to handle. As a result, characteristics of the spool are changed.

The difference between the height of an optical fiber drawing slot and the thickness of a pad brings about several problems including the increase of nonlinearity of the optical fiber. That is, when the optical fiber is drawn through the slot from a shock-absorbing sponge pad, the optical fiber may be caught between the pad and an inner side surface of the flange or forcedly drawn around an auxiliary winding portion, thereby bending the optical fiber. This is a cause of optical fiber failures.

The above problems can be summarized as follows:

(1) it is difficult to wind a long length of optical fiber around the earlier spool because the spool is designed to wind an optical fiber of a 15–20 km length;

(2) the flanges of the spool are warped and the spool is seriously deformed depending on temperature when it is used for a long length winding;

(3) because the optical fiber is non-linear due to the difference between the height of the optical fiber drawing slot and the thickness of the pad, an accurate loss value is difficult to obtain; and (4) when a long length of optical fiber is wound around the spool, the weight of the spool is increased, causing difficulty in transporting and storing the spool and protecting the optical and mechanical characteristics of the optical fiber from an external environment.

The following patents each disclose features in common with the present invention but do not teach or suggest the specifically recited optical fiber spool and spool cover of the present invention: U.S. Pat. No. 3,650,388 to Osojnak, entitled Tape Canister, U.S. Pat. No. 1,488,322 to Doty, entitled Film Reel Cover, U.S. Pat. No. 1,702,242 to Bureau, entitled Reel, U.S. Pat. No. 4,635,789 to Webb, entitled Locking Mechanism For Magnetic Tape, U.S. Pat. No. 4,974,789 to Milburn, entitled Dispensing Package For A Fiber-Optic Device, U.S. Pat. No. 5,702,066 to Hurst et al., entitled Optical Fiber Spool And Method Of Loading Spool, U.S. Pat. No. 1,981,139 to Bureau, entitled Reel, U.S. Pat. No. 3,391,879 to Le Bus Sr., entitled Non-Crushing Multi-Layer Cable Spooling Method And Apparatus Therefor, and U.S. Pat. No. 2,741,441 to Le Bus Sr., entitled Method And Apparatus Of Cross-Over Cable Spooling.

SUMMARY OF THE INVENTION

A first object of the present invention is to provide an optical fiber spool around which an optical fiber can be wound at least 30 km long by increasing the difference between the diameters of a barrel and a flange to 95–100 mm and the thickness of reinforcing ribs to 3 mm or larger.

A second object of the present invention is to provide an optical fiber spool whose deformation depending on temperature is suppressed.

A third object of the present invention is to provide an optical fiber spool which can prevent non-linearity of an optical fiber by positioning an optical fiber drawing slot at a higher place in the direction of an outer circumference of the spool.

A fourth object of the present invention is to provide an optical fiber spool cover which maintains optical characteristics of an optical fiber and is easy to transport and store.

To achieve the above objects, there is provided an optical fiber spool. In the optical fiber spool, an optical fiber is wound around a barrel, a pad covers the outer surface of the barrel, for relieving impacts, and two flanges face each other to support the barrel. A reinforcing rib is fixed on each of the flange, for supporting the wound optical fiber, and an auxiliary winding portion is disposed on the outer surface of a flange, for winding a beginning portion of the optical fiber. An optical fiber drawing slot is positioned on the flange, spaced from an inner circumference of the flange in the direction of an outer circumference thereof by a predetermined distance, and has an upper surface apart from the inner circumference of flange by 2t assuming that the thickness of the pad is t.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
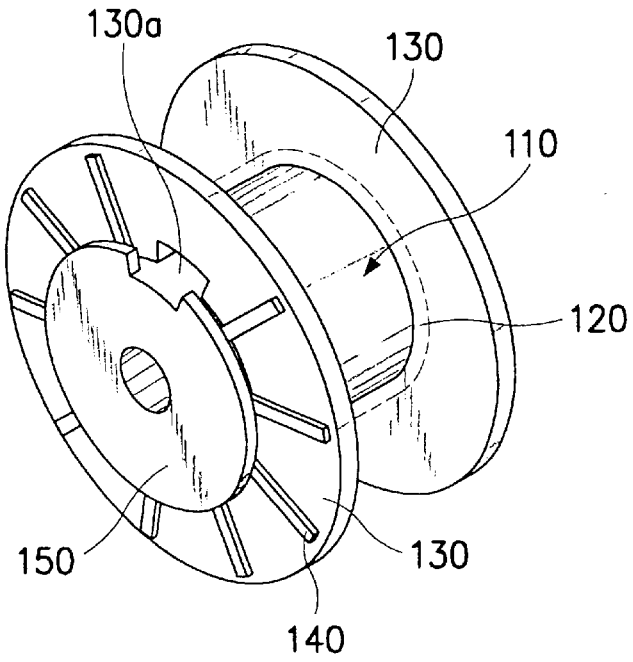
Related Art FIG. 1
FIG. 1 is a perspective view of an earlier optical fiber spool.

The most preferred embodiments of the present invention will be described in detail with reference to the attached drawings. Like reference numerals denote the same components in the drawings, and a detailed description of related known functions and structure of the present invention have been avoided if deemed to obscure the subject matter of the present invention.

FIG. 1 is a perspective view of the earlier optical fiber spool discussed in the Description of the Related Art above. The optical fiber spool 100 has a cylindrical barrel 110 and two flanges 130 facing each other with the barrel 110 inbetween. The spool 100 is easy to handle because the difference between the diameters of the barrel 110 and the flanges 130 is narrow, and an optical fiber wound around the spool 100 is lightweight.

Figure 2:
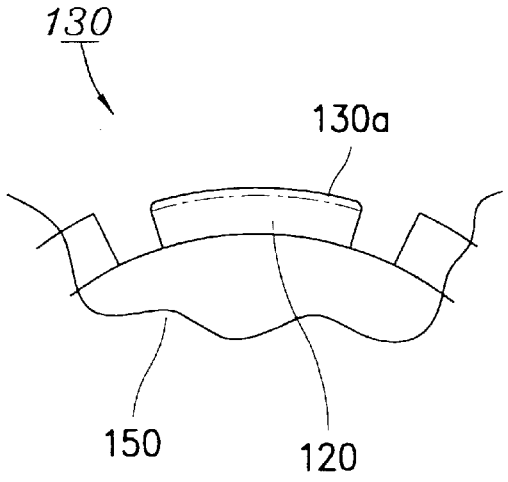
Related Art FIG. 2
FIG. 2 is a frontal view of an optical fiber drawing slot in the earlier optical fiber spool.

As shown in FIG. 2, the difference between the height of an optical fiber drawing slot 130*a* and the thickness of a pad 120 brings about several problems including the increase of nonlinearity of the optical fiber. That is, when the optical fiber is drawn through the slot 130*a* from a shock-absorbing sponge pad 120, the optical fiber may be caught between the pad 120 and an inner surface of a flange 130 or forcibly drawn around an auxiliary winding portion 150, thereby bending the optical fiber.

Figure 3:
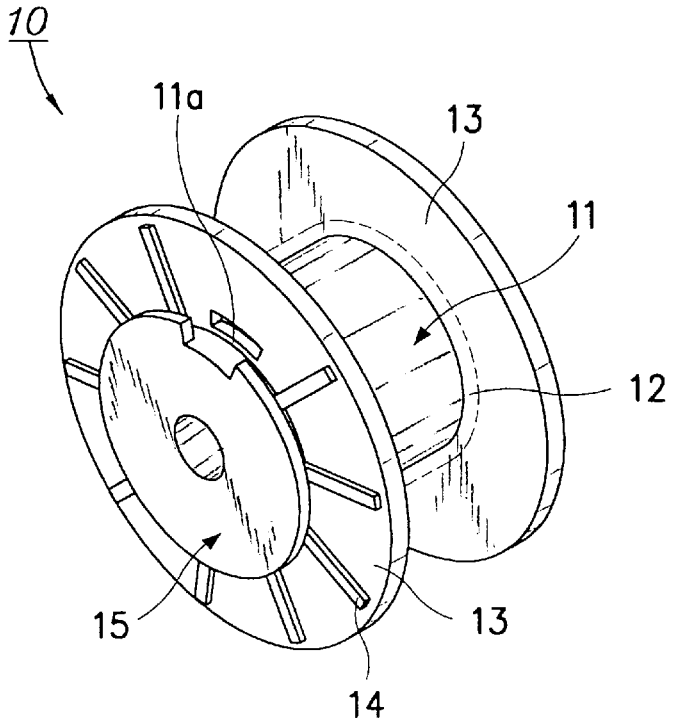
FIG. 3 is a perspective view of an optical fiber spool according to a preferred embodiment of the present invention.

FIG. 3 is a perspective view of an optical fiber spool according to a preferred embodiment of the present invention.

Referring to FIG. 3, an optical fiber spool 10 has a barrel 11 around which an optical fiber is wound, a sponge pad 12 indicated by a dotted line, for covering the barrel 11, flanges 13 for supporting the barrel 11, reinforcing ribs 14 fixed on the flanges 13 to support the wound optical fiber, an auxiliary winding portion 15 positioned on the outer surface of a flange 13, for winding the beginning portion of the optical fiber, and an optical fiber drawing slot 13*a* disposed on the flange 13, apart from an inner circumference 11*a* of the flange 13 in the direction of an outer circumference thereof by a predetermined distance and having an upper surface spaced from the inner circumference 11*a* of the flange 13 by 2t assuming that the thickness of the pad 12 is t.

The above components of this optical fiber spool 10 for use in storing or transporting an optical fiber are integrally formed by injection. The barrel 11, around which an optical fiber is wound, is covered with the sponge pad 12. The pad 12 serves to relieve impacts for the wound optical fiber. Here, the difference between the diameters of the barrel 11 and the flanges 13 is set to 95–100 mm in order to wind the optical fiber at least 30 km long. The thickness of the reinforcing ribs 14 are increased to 3 mm to prevent the edge of the flanges 13 from being warped due to the increase of stresses generated in the central direction of the bulky wound optical fiber. That is, a longer optical fiber can be wound by making the reinforcing ribs 14 thicker.

Figure 4:
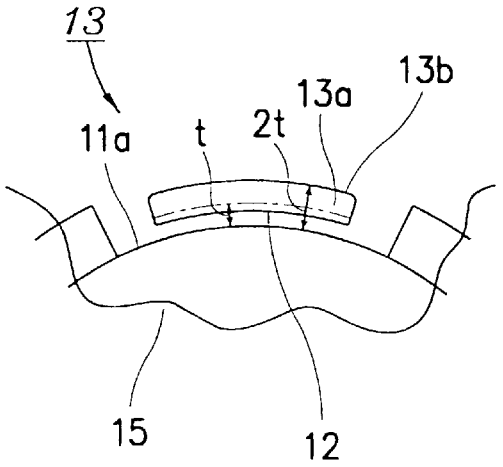
FIG. 4 is a frontal view of an optical fiber drawing slot in the optical fiber spool according to the preferred embodiment of the present invention.

As shown in FIG. 4, the optical fiber drawing slot 13*a* is formed to draw the optical fiber around the auxiliary winding portion 15. Here, the slot 13*a* is apart from the inner circumference 11*a* of the flange 13 in the direction of the outer circumference thereof by a predetermined distance. More specifically, assuming that the thickness of the pad 12 is t, the distance between the inner circumference 11*a* of the flange 13 and the upper surface 13*b* of the slot 13*a* is set to 2t. That is, in consideration of the diameter of the optical fiber, the thickness t of the pad 12 is half the distance 2t between the inner circumference 11*a* of the flange 13 and the upper surface 13*b* of the slot 13*a*. The optical fiber is most preferably drawn through the slot 13*a* and wound around the auxiliary winding portion 15.

Figure 5:
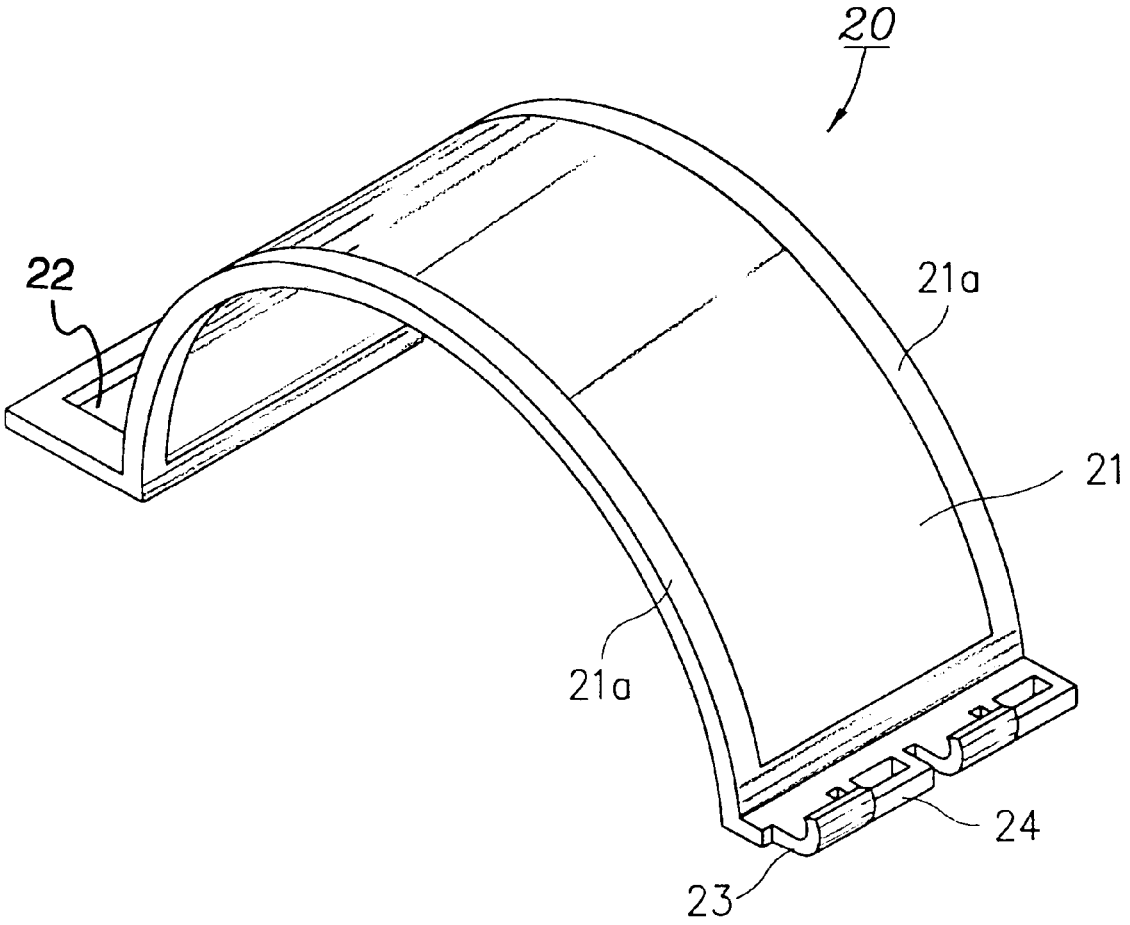
FIG. 5 is a perspective view of an optical fiber spool cover according to another preferred embodiment of the present invention.

FIG. 5 is a perspective view of an optical fiber spool cover according to another embodiment of the present invention. Referring to FIG. 5, an optical fiber spool cover 20 includes a semicircular cover portion 21 having a spool guide 21 in the periphery thereof, for covering a spool, a handle 22 at one side of the cover portion 21, for use in transporting the optical fiber spool, and at least one hook 23 and a catching portion 24 for catching the hook 23, at the other side of the cover portion 21. When two or more hooks 23 are present, they are spaced from each other with a catching portion 24 inbetween.

The above spool cover 20 protects the spool having an optical fiber wound therearound from an external environment and engages with another symmetrical counterpart, facing each other with the spool kept therebetween. The cover portion 21 covers the optical fiber, and the spool guide 21*a* holds the flanges when the spool covers are assembled on the spool. Thus, the optical fiber is prevented from being bent by stresses or tension. The handle 22 facilitates storage and transportation of the spool which becomes heavier due to long optical fiber winding, and protects the optical fiber from external impacts while the optical fiber is stored.

For assembly of two spool covers 20, they are identically molded and assembled, face-to-face. At this time, alternately arranged hooks 23 and catching portions 24 of one spool cover catch their corresponding catching portions 24 and hooks 23 of the other spool cover, thereby fixing the spool covers 20.

As described above, the optical fiber spool and spool cover have the following advantages. The earlier optical spool was generally capable of winding an optical fiber 15–20 km long, whereas the spool of the present invention can wind an optical fiber at least 30 km long. In addition, deformation of the spool is suppressed by increasing the thickness of the reinforcing ribs and the weight of the spool, and an optical fiber is prevented from being bent by disposing the optical fiber drawing slot at a higher position. Furthermore, the spool is easy to handle by packaging the spool with the spool cover having a handle.

While the present invention has been described in detail with reference to the specific embodiments, they are mere exemplary applications. Thus, it is clearly understood that many variations can be made by anyone skilled in the art within the scope and spirit of the present invention.

What is claimed is:

1. An optical fiber spool comprising:

a barrel around which an optical fiber is wound;

a resilient pad covering the outer surface of the barrel, for relieving impacts;

two flanges facing each other for supporting the barrel;

a reinforcing rib fixed on each of the flanges, for supporting the wound optical fiber;

an auxiliary winding portion disposed on an outer surface of one of the two flanges, for winding a beginning portion of the optical fiber; and an optical fiber drawing slot positioned on the one flange, spaced from an inner circumference of the one flange in a direction toward an outer circumference thereof by a predetermined distance, and having an upper surface spaced apart from the inner circumference of the one flange by a distance 2t, the thickness of the pad being t.

2. The optical fiber spool as claimed in claim 1, the difference between the diameters of the barrel and the flanges is in the range of 95–100 mm.

3. An optical fiber spool cover comprising:

a pair of semicircular cover portions including a spool guide in the periphery thereof, for together covering a spool having an optical fiber wound therearound from the outside;

a handle at one side of each of the cover portions, the handles mating together for transporting the optical fiber spool;

at least one hook at another side of each of the cover portions; and at least one catching portion of each of the cover portions for respectively catching the at least one hook of the other of the pair of cover portions.

4. An optical fiber spool and spool cover comprising:

a barrel around which an optical fiber is wound;

a resilient pad covering the outer surface of the barrel, for relieving impacts;

two flanges facing each other for supporting the barrel;

a reinforcing rib fixed on each of the flanges, for supporting the wound optical fiber;

an auxiliary winding portion disposed on an outer surface of one of the two flanges, for winding a beginning portion of the optical fiber;

an optical fiber drawing slot positioned on the one flange, spaced from an inner circumference of the one flange in a direction toward an outer circumference thereof by a predetermined distance, and having an upper surface spaced apart from the inner circumference of the one flange by a distance 2t, the thickness of the pad being t;

a pair of semicircular cover portions including a spool guide in the periphery thereof, for covering the optical fiber spool having an optical fiber wound therearound from the outside;

a handle at one side of each of the cover portions for transporting the optical fiber spool;

at least one hook at another side of each of the cover portions; and at least one catching portion of each of the cover portions for respectively catching the at least one hook of the other of the pair of cover portions.

5. The optical fiber spool as claimed in claim 4, the difference between the diameters of the barrel and the flanges is in the range of 95–100 mm.

* * * * *